US005678341A

United States Patent [19]

Kahnke

[11] Patent Number: 5,678,341

[45] Date of Patent: Oct. 21, 1997

[54] MUZZLELOADER FIREARM

[76] Inventor: Gordon A. Kahnke, 206 W. 11th St., Redwood Falls, Minn. 56583

[21] Appl. No.: 723,677

[22] Filed: Sep. 30, 1996

[51] Int. Cl.[6] ..... F41C 7/00

[52] U.S. Cl. ..... 42/51

[58] Field of Search ..... 42/51, 8, 10, 14, 42/76.01; 89/145

[56] References Cited

U.S. PATENT DOCUMENTS

| | | | |
|---|---|---|---|
| 3,577,677 | 5/1971 | Kern | 42/69 |
| 3,757,447 | 9/1973 | Rowe | 42/51 |
| 4,065,867 | 1/1978 | Storey | 42/69 R |
| 4,123,866 | 11/1978 | Wiethoff | 42/77 |
| 4,447,977 | 5/1984 | Holmgren | 42/51 |
| 4,503,633 | 3/1985 | Davis | 42/51 |
| 4,700,499 | 10/1987 | Knight | 42/51 |
| 4,715,139 | 12/1987 | Rodney, Jr. | 42/51 |
| 4,989,357 | 2/1991 | Norman et al. | 42/70.08 |
| 5,375,358 | 12/1994 | Riness et al. | 42/27 |
| 5,454,182 | 10/1995 | Lewis et al. | 42/51 |

*Primary Examiner*—Charles T. Jordan
*Assistant Examiner*—Meena Chelliah
*Attorney, Agent, or Firm*—Burd, Bartz & Gutenkauf

[57] ABSTRACT

A compact muzzleloader firearm has a barrel and a ramrod mounted below the barrel. The ramrod extends through a tubular member supporting a slide block connected to a hammer with struts. A spring mounted on the tubular member biases the slide block to move the hammer from a cocked position to a fire position. A manually operated safety structure on side plates adjacent the hammer prevents the hammer from moving to the fire position. The safety structure is also releasable to allow the hammer to move from the cocked position to the fire position.

25 Claims, 4 Drawing Sheets

MUZZLELOADER FIREARM

FIELD OF THE INVENTION

This invention relates to a muzzleloader firearm and in particular, to a muzzleloader firearm having a reliable and compact hammer biasing mechanism that causes a rapid hammer fall with small vibrational disruption.

BACKGROUND OF THE INVENTION

Muzzleloader firearms are available for competitive shooting and for hunting of game. Government natural resource departments have encouraged primitive weapon hunting seasons for hunters desiring to take game with muzzleloader firearms. A number of states have established separate muzzleloader firearms seasons.

In recent years improvements in muzzleloader firearms have been made in the hammer locks, safety mechanisms to prevent inadvertent discharge of the weapon, and firing mechanisms. Lacks for muzzleloader rifles having coil springs biasing hammers toward firing positions are disclosed by R. P. Kern and A. J. Hamm in U.S. Pat. No. 3,577,667. The hammers are long pivoted levers coupled to triggers whereby upon actuation of the triggers the levers are released and moved by the coil springs to impact against caps to effect detonation of the powder in the barrels. A similar coil spring actuated firing mechanism is disclosed by J. W. Norman and C. W. Rowell in U.S. Pat. No. 4,989,357. This firearm includes a safety mechanism that blocks the fall of the hammer from the cock position to the firing position. The safety mechanism can be released to allow the hammer to impact against a cap to detonate powder positioned in the barrel of the firearm. Muzzleloader firearms having in line ignition mechanisms are disclosed by C. Davis, E.d. Jasper and R. Bohm in U.S. Pat. No. 4,503,633 and A. S. Lewis and J. W. Murphy in U.S. Pat. No. 5,454,182. Coil springs and hammers of the ignition mechanisms are located in line with the barrels in enclosed positions to protect the parts of the mechanisms and minimize the noise generated upon firing of the firearms.

SUMMARY OF THE INVENTION

The muzzleloader firearm of the invention has a zero length firing mechanism with an optimum balance point making it easy to handle and use with effective accuracy. The firing mechanism is structurally compact and has a rapid hammer fall with a minimum of vibrational disruption. The firearm has a relatively long barrel with a slim profile and a short over all length. The long barrel results in greater energy output and increased target accuracy of the projectile.

The muzzleloader firearm has a longitudinal barrel with a muzzle end and a breech end closed with a breech plug. A hammer is moved with a coil spring into impact engagement with a cap mounted on the breech plug to ignite powder within the barrel causing a projectile to be ejected from the barrel. The spring in telescoped over a tubular member mounted below the barrel. The spring biases a block slidably located on the tubular member to move the hammer from a cocked position to a fire position. Struts connect the block to the hammer to transmit linear movement of the block to pivotal movement of the hammer. A trigger holds the hammer in its cocked position. When the trigger is manually released the spring moves the block along the tubular member causing the hammer to pivot from the cocked position to the fire position. The firearm has a pair of side plates securing the barrel to a stock. The tubular member, spring, block and struts are combined between the side plates to provide an effective and compact combination of operative structure. A safety mechanism movably mounted on the side plates is selectively operable to prevent the hammer from striking the cap and to permit the hammer to strike the cap and thereby discharge the firearm.

A preferred embodiment of the muzzleloader is a firearm in a rifle having an elongated tubular barrel with an open muzzle end and a breech end closed with a breech plug. A pair of side plates connect the barrel to a stock. A ramrod is stored below the barrel with holders and a tubular member connected to the barrel and side plates. The tubular member mounted on the side plates has an internal passage accommodating an end of the ramrod and an external cylindrical surface accommodating a coil spring and a slide block. Struts connect the slide block to a hammer pivotally mounted on the side plates for movement between cocked and fire positions. A trigger engageable with the hammer retains the hammer in its cocked position which is subject to the compression force of the coil spring. When the trigger is released from the hammer, the hammer pivots to impact engagement with a cap on the breech plug thereby igniting the powder in the barrel causing the projectile to be discharged from the barrel. A rotatable safety member mounted on the side plates has a portion that can be located in the path of movement of the hammer to prevent the hammer from engaging the cap to eliminate inadvertent discharge of the fire arm. The safety member can be manually rotated to reposition the portion of the member to allow the hammer to strike the cap to discharge the firearm.

The advantages and objects of the muzzleloader firearm of the invention are included in the following drawings and description of a preferred embodiment of the firearm.

DESCRIPTION OF PREFERRED EMBODIMENT

Figure 1:
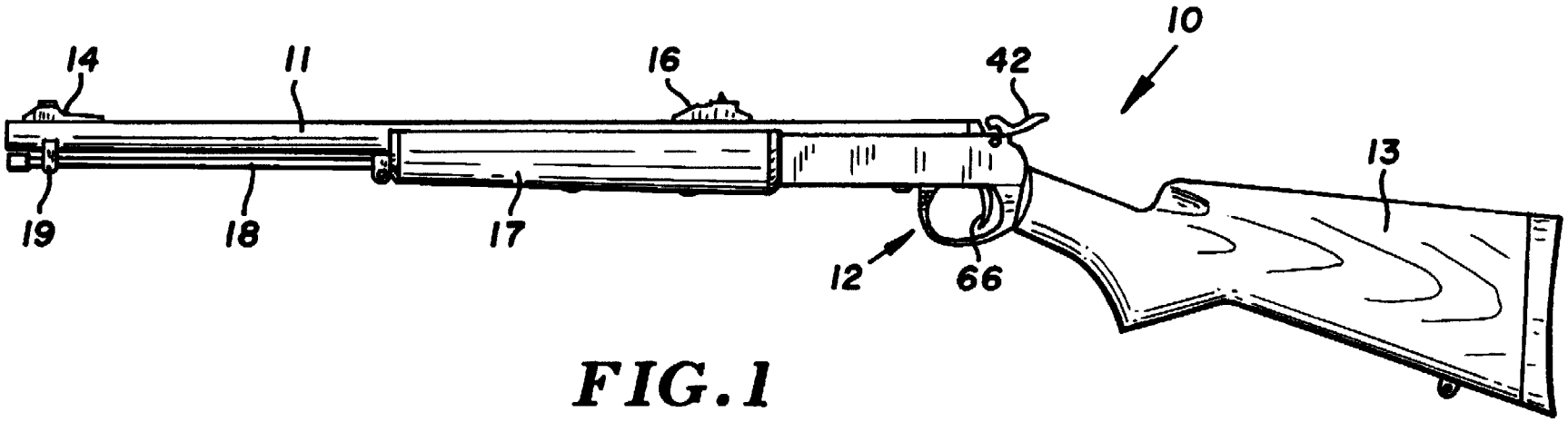
FIG. 1 is a side elevational view of the muzzleloader firearm of the invention.
Figure 2:
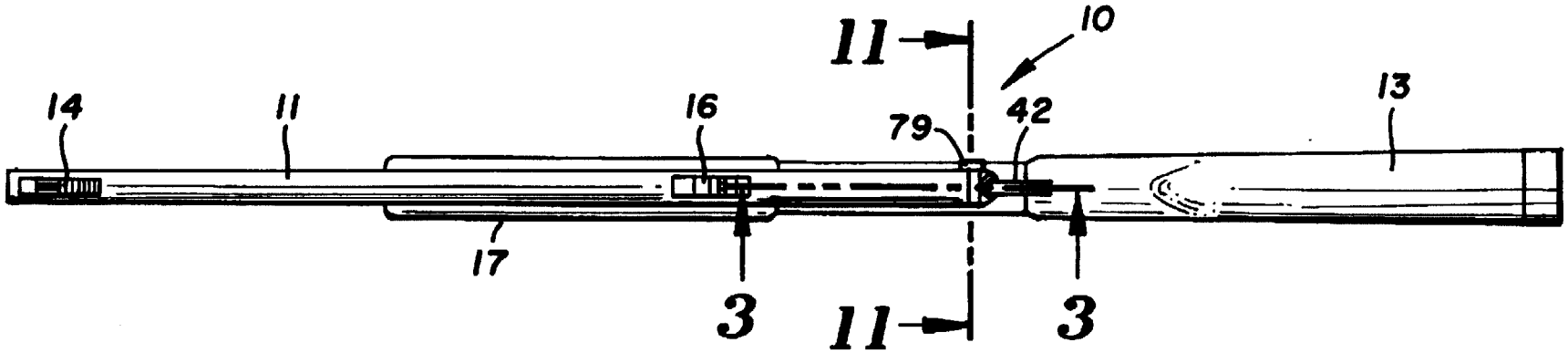
FIG. 2 is a top plan view thereof.

A black powder muzzleloader firearm 10, shown in FIGS. 1 and 2, is a muzzleloading rifle having a longitudinal linear barrel 11, a hammer and trigger assembly 12 secured to barrel 11, and a stock 13 attached to hammer and trigger assembly 12 with a bolt 15. Firearm 10 has a balance point shaped to fit the hand, a slim profile and zero length action. The barrel 11 has a 24 inch length with firearm 10 having a 38 inch overall length. The long barrel 11 has more energy output and increases the accuracy and precision of the firearm 10. The length of barrel 11 and overall length of firearm 10 can vary. The following description is directed to a rifle firearm. The spring over a tubular member and hammer firing mechanism herein described can be incorporated into a muzzleloader pistol and other types of firearms.

Firearm 10 has sight components 14 and 16, such as a post and "V", mounted on the top of barrel 11. A forearm member 17 is mounted below barrel 11 forwardly of hammer and trigger assembly 12. A ramrod 18 extended through a holder 19 on the muzzle end of barrel 12 is located below and parallel to barrel 11. A leaf spring 21, shown in FIGS. 3 and 5, attached to barrel 11 bears against ramrod 18 to retain ramrod 18 in its stored position below barrel 11.

Figure 3:
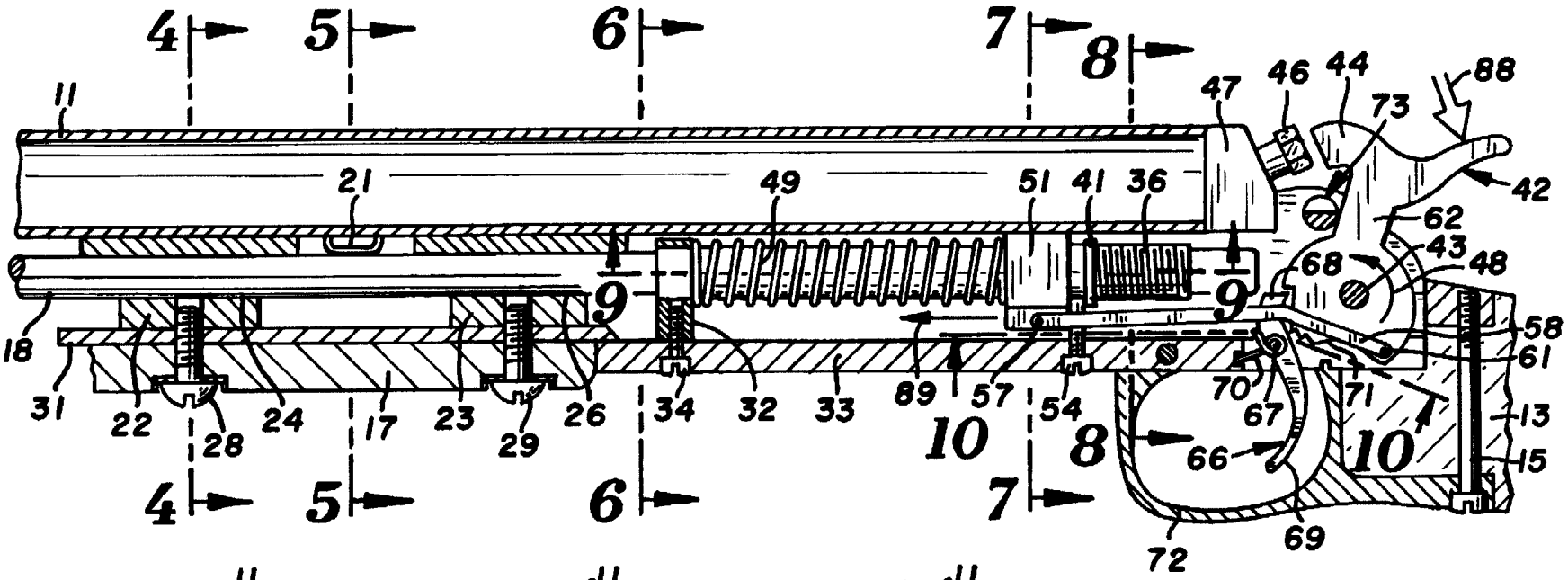
FIG. 3 is an enlarged sectional view taken along the line 3—3 of FIG. 2.
Figure 6:
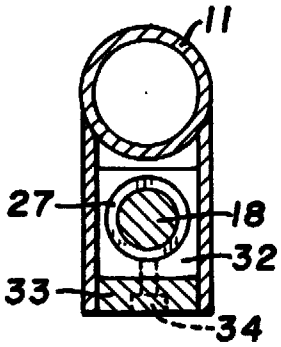
FIG. 6 is an enlarged sectional view taken along line 6—6 of FIG. 3.
Figure 5:
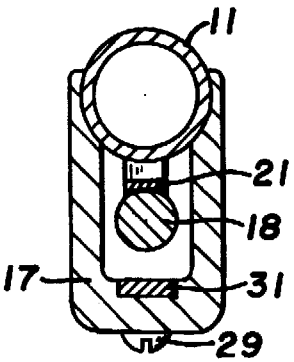
FIG. 5 is an enlarged sectional view taken along line 5—5 of FIG. 3.
Figure 4:
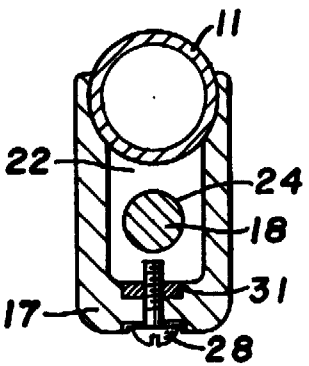
FIG. 4 is an enlarged sectional view taken along line 4—4 of FIG. 3.
Figure 9:
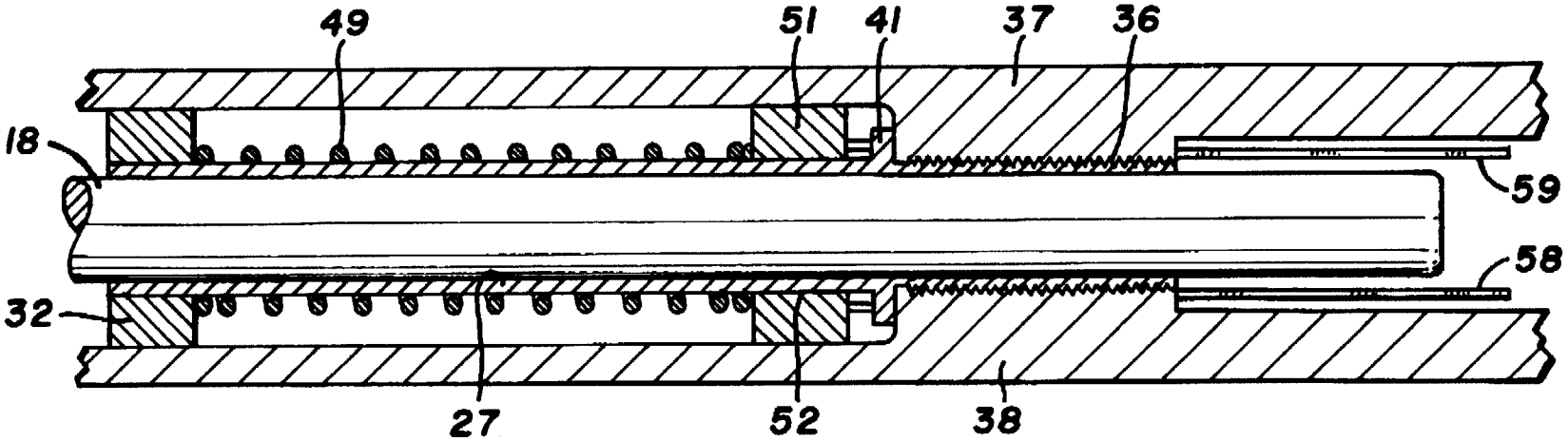
FIG. 9 ia an enlarged sectional view taken along line 9—9 of FIG. 3.

As shown in FIGS. 3, 4 and 5 a pair of barrel and forearm mounts or blocks 22 and 23 mounted on barrel 11 have longitudinally aligned bores 24 and 26. Ramrod 18 extends through bores 24 and 26 into a tubular member or cylindrical sleeve 27. Bolts 28 and 29 secure forearm member 17 and a bar or plate 31 to block 24 and 26. Plate 31 is attached to a base 32 and can be a one-piece metal member. A support 32 for a tubular member or cylindrical sleeve 27 is attached to base 33 with a bolt 34 to fix the location of support 32 on base 33. The proximal or rear end 36 of tubular member 27 is threaded into adjacent threaded concave sections of side plates 37 and 38 attached to opposite sides of base 33 with bolts 39. Tubular member 27 has an annular outwardly directed rib 41 that engages side plates 37 and 38, as shown in FIG. 9, to fix the position of tubular member 27 relative to side plates 37 and 38. Tubular member 27, located and supported between the bottom of barrel 11 and base 33, does not increase the vertical and transverse dimensions of firearm 10. The combined arrangement of tubular member 27 and trigger biasing structure herein described does not increase the length and weight of the firearm nor alter the balance of the firearm.

Figure 7:
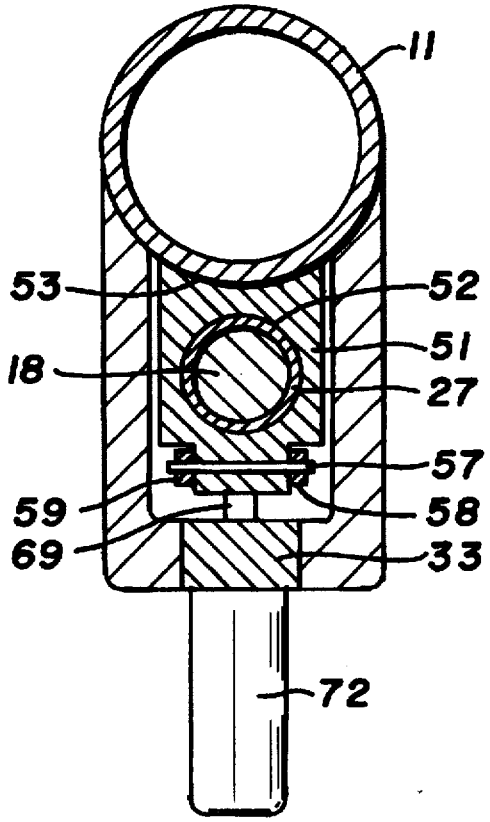
FIG. 7 is an enlarged sectional view taken along line 7—7 of FIG. 3.
Figure 8:
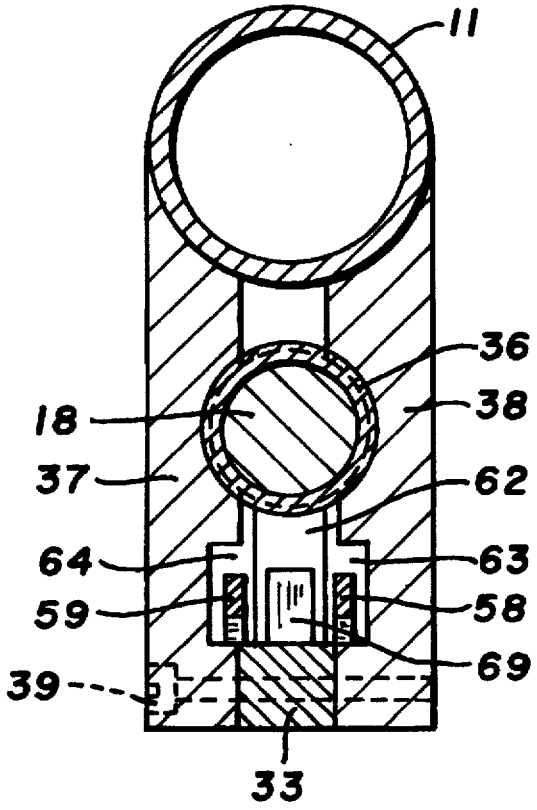
FIG. 8 in an enlarged sectional view taken along line 8—8 of FIG. 3.
Figure 10:
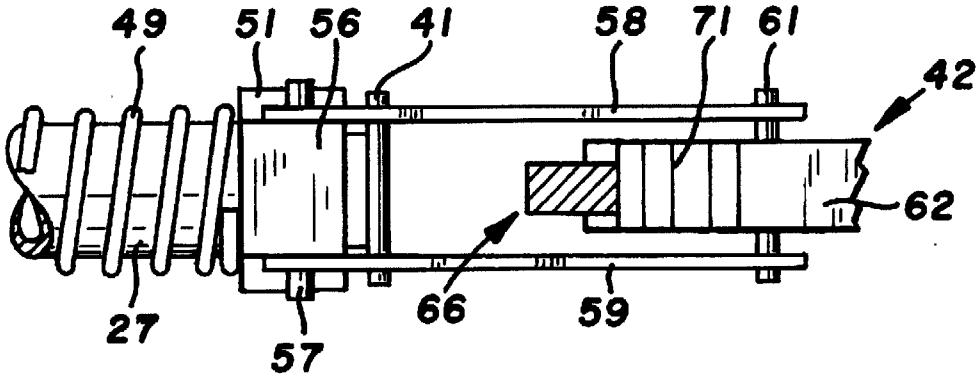
FIG. 10 is an enlarged sectional view taken along line 10—10 of FIG. 3.

As shown in FIG. 3, a hammer 42 is pivotally mounted on a pin 43 connected to side plates 37 and 38. Hammer 42 has a head 44 movable relative to a cap 46 on a breech plug 47 connected to the proximal or breech end of barrel 11. Cap 46 and breech plug 47 are conventional muzzleloading rifle structures. Hammer 42 is rotated in a counter clockwise direction or firing direction shown by arrow 48 by the biasing force of a coil compression spring 49. The tubular member 27 has an outer cylindrical surface between rib 41 and support 32 that accommodates spring 49. Spring 49 surrounds tubular member 27 and has a first end that engages support 32. The second or opposite end of spring 49 bears against a slide block 51 having a bore 52 for the outer surface of tubular member 27 to slidably mount slide block 51 on tubular member 27. Spring 49 is a coil compression spring that is free to slide on the outer cylindrical surface of tubular member 27 which serves as a longitudinal guide for spring 49. Tubular member 27 also prevents spring 49 from bending and buckling. Spring 49 when compressed exerts a smooth and constant biasing force toward the breech end of firearm 10. Spring 49 being relatively long has consistent biasing force and a long operative life. Block 51 has a concave upper surface 53, shown in FIG. 7, located adjacent a convex lower segment of barrel 11 to minimize rotation of block 51 on tubular member 27. Block 51 is spaced a short distance from rib 41 with a bolt 54 mounted on base 33. The bottom of block 51 has a downwardly projected boss 56 supporting a transverse pin 57. As seen in FIGS. 7 and 10, a pair of hammer struts 58 and 59 are pivotally mounted on opposite ends of pin 57 and a pin 61 mounted on hammer body 62 below and rearwardly of pin 43. As shown in FIG. 8, struts 58 and 59 extend through inside grooves 63 and 64 in side plates 37 and 38 and are located adjacent opposite side of hammer body 62.

A trigger 66 is pivotally mounted on a pin 67 secured to base 33 for movement between a cocked position and a firing position. Trigger 66 has a upwardly directed finger or sear 68 and a downwardly directed lever or finger actuator 69. The lower edge of hammer body 62 has a number of notches 71 for accommodating sear 68 to hold hammer 42 in the cocked position. A trigger guard 72 located around trigger finger 69 is connected to base 33 with fasteners (not shown) and stock 13 with bolt 15.

Figure 11:
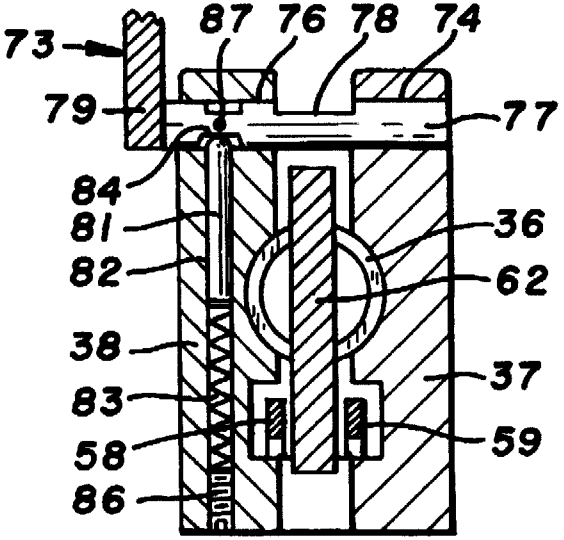
FIG. 11 is an enlarged sectional view taken along line 11—11 of FIG. 2.

Firearm 10 has a hand operated safety, indicated generally at 73 in FIGS. 3 and 11, to prevent inadvertent striking of hammer head 44 on cap 46 thereby discharging firearm 10. As shown in FIG. 11, side plates 37 and 38 have aligned transverse bores 74 and 76 adjacent the upper edges of the plates. A rotatable member 77 fits in bores 74 and 76. The middle section 78 of member 77 located between side plates 37 and 38 is cut in half so that it has a semi-circular cross section, as shown in FIG. 3, when section 78 is in the horizontal position, as seen in FIG. 3, hammer head 44 can not engage cap 46. Member 77 must be turned about 90 degrees before hammer head 44 can strike cap 46 and thereby ignite the powder to discharge firearm 10. A thumb wheel 79 secured to an end of member 77 is used to manually turn member 77. A detent 81 located in a bore 82 is biased by a coil spring 83 into engagement with a flat portion 84 of member 77. A plug screw 86 threaded into bore 82 thereby holding member 77 in a lock position. Member 77 has a hole 87 circumferentially spaced from flat portion 84 to accommodate the rounded forward end of detent when member 77 has been turned to its unlock or fire position.

In use barrel 11 is loaded with black powder and a projectile from the muzzle end of barrel 11. Ramrod 18 is removed from its stored position below barrel 11 and inserted into barrel 11. Tamping motions of ramrod 18 lodges the powder and projectile in the breech end of barrel 11. Safety 73 is in the lock position, as shown in FIG. 1 during the loading of firearm 10.

Firearm 10 is discharged by moving hammer clockwise or downward, as shown by arrow 88 in FIG. 3. Hammer struts 58 and 59 force slide block 51 in a forward direction, shown by arrow 89, compressing spring 49. Hammer 42 is rotated about pin 43 until sear 68 of trigger 66 fits into notch 71 to hold trigger in the cocked position.

Firearm safety 73 is turned about 90 degrees so that hammer head 44 can hit cap 46 thereby igniting the powder and expelling the projectile from barrel 11 toward the target selected by the shooter. The shooter slowly pulls the trigger lever 69 rearwardly with the barrel aimed at the target, when trigger sear 68 is moved out of notch 71, trigger 42 is rotated counter clockwise, as shown by arrow 48, by the action of spring 49. Hammer head 44 rapidly moves toward cap 46 and strikes cap 46. Which ignites the powder in barrel causing projectile to be propelled from barrel 11. Safety 73 is then returned to its lock position by rotary thumb wheel 79 about 90 degrees. Detent 81 holds safety 73 in the lock position. Firearm 10 is ready to reload with another charge of powder and a projectile.

While there has been shown and described a muzzleloader firearm as a rifle, it is understood that changes in structure and materials and modifications may be made by those skilled in the art without departing from the invention. The invention is described int he following claims.

I claim:

1. A muzzleloader firearm comprising:

a barrel having a muzzle end and a breech end, a stock, first means securing the barrel to the stock, a ramrod for positioning an explosive powder in said barrel, second means connected to the first means for holding the ramrod below and generally parallel to the barrel including a tubular member located adjacent the breech end of the barrel, a breech plug secured to the breech end of the barrel, a cap mounted on the breech plug adapted to ignite powder in said barrel, a hammer pivotally mounted on the first means for movement between cocked and fire positions, said hammer having a head for striking the cap thereby igniting the powder in the barrel, a trigger pivotally mounted on the first means engageable with the hammer to hold the hammer in the cocked position, a spring movably mounted on the tubular member, said second means including a mount engageable with the spring, a slide block movably mounted on the tubular member engageable with the spring, hammer strut means connecting the hammer to the slide block whereby movement of the hammer from the fire position to the cocked position moves the slide block on the tubular member in a direction to compress the spring, said trigger engageable with the hammer to hold the hammer in the cocked position with the spring compressed whereby when the trigger is released from the hammer the spring moves the slide block causing the hammer to pivot from the cocked position to the fire position wherein the hammer head strikes the cap causing the powder in the barrel to ignite which propels the projectile from the barrel.

2. The muzzleloader firearm of claim 1 wherein:

the first means include side plates attached to the barrel and stock, said side plates having concave portions attached to the tubular member.

3. The muzzleloader firearm of claim 2 wherein:

the tubular member has an end attached to the concave portions, said end of the tubular member and concave portions having cooperating connecting means for mounting the tubular member on the side plates.

4. The muzzleloader firearm of claim 2 wherein:

the side plates have grooves for accommodating the hammer strut means between the hammer and the slide block.

5. The muzzleloader firearm of claim 1 wherein:

the first means include a pair of side plates laterally spaced from each other connecting the barrel to the stock, said tubular member, spring, slide block, and hammer strut means being located in the space between the side plates.

6. The muzzleloader firearm of claim 1 wherein:

the hammer strut means comprise a pair of rigid struts, first pivot means connecting the struts to the hammer, and second pivot means connecting the struts to the slide block.

7. The muzzleloader firearm of claim 6 wherein:

the first means include laterally spaced side plates having inside surfaces, said inside surfaces having grooves for accommodating the struts and said first and second pivot means.

8. The muzzleloader firearm of claim 7 wherein:

the inside surfaces of the side plates have portions connected to the tubular member to support the tubular member on the side plates.

9. The muzzleloader firearm of claim 1 wherein:

the first means includes side plates, and means mounted on the side plates movable to a first position to prevent the hammer from striking the cap and movable to a second position to allow the hammer to strike the cap.

10. A muzzleloader firearm comprising:

a barrel having a muzzle end and a breech end, a stock, a (pair of side plates and a base member connecting the barrel to the stock,) said side plates being laterally spaced from each other, a cylindrical member located between the side plates, first means mounting the cylindrical member on the side plates, second means spaced from the first means mounting the cylindrical member on the base member, a breech plug located adjacent the breech end of the barrel, a cap associated with the breech plug, a hammer adapted to strike the cap to ignite powder located in said barrel, pivot means mounting the hammer on the side plates for movement between a cock position and a fire position, a slide block movably mounted on the cylindrical member, strut means connected to the slide block and hammer, biasing means engageable with the slide block for moving the slide block on the cylindrical member to pivot the hammer from the cocked position to the fire position and trigger means for holding the hammer in the cocked position, said trigger means being movable to release the hammer whereby the biasing means moves the hammer from the cocked position to the fire position.

11. The muzzleloader firearm of claim 10 wherein:

the first means comprises cooperating means on the side plates and cylindrical member mounting the cylindrical member on the side plates.

12. The muzzleloader firearm of claim 11 wherein:

the cooperating means include concave curved portions in the side plates accommodating opposite side portions of the cylindrical member.

13. The muzzleloader firearm of claim 10 wherein:

the side plates have inside surfaces, at least one of said inside surface having a groove for accommodating the strut means.

14. The muzzleloading firearm of claim 10 wherein:

the strut means comprise a plurality of struts connected to the slide block and the hammer.

15. The muzzleloading firearm of claim 14 wherein:

each side plates has a groove for accommodating a strut.

16. The muzzleloading firearm of claim 10 wherein:

the biasing means comprises a coil spring surrounding the cylindrical member and engageable with the slide block to move the slide block relative to the cylindrical member to thereby move the hammer from the cocked position to the fire position.

17. The muzzleloader firearm of claim 10 including:

means movable mounted on the side plates selectively operable to prevent the hammer from striking the cap and to permit the hammer to strike the cap.

18. A muzzleloader firearm comprising:

a barrel having a muzzle end and a breech end, a stock, first means securing the barrel to the stock, a cylindrical member located adjacent the breech end of the barrel, a breech plug secured to the breech end of the barrel, a cap mounted on the breech plug adapted to ignite powder in said barrel, a hammer pivotally mounted on the first means for movement between cocked and fire positions, said hammer having a head for striking the cap thereby igniting the powder in the barrel, a trigger pivotally mounted on the first means engageable with the hammer to hold the hammer in the cocked position, a spring movably mounted on the cylindrical member, a fixed mount secured to the first means engageable with the spring, a slide block movably mounted on the tubular cylindrical member engageable with the spring, hammer strut means connecting the hammer to the slide block whereby movement of the hammer from the fire position to the cocked position moves the slide block on the cylindrical member in a direction to compress the spring, said trigger being engageable with the hammer to hold the hammer in the cocked position with the spring compressed whereby when the trigger is released from the hammer the spring moves the slide block causing the hammer to pivot from the cocked position to the fire position wherein the hammer head strikes the cap causing the powder in barrel to ignite which propels the projectile from the barrel.

19. The muzzleloader firearm of claim 18 wherein:

the first means include side plates attached to the barrel and stock, said side plates having concave portions attached to the cylindrical member.

20. The muzzleloader firearm of claim 19 wherein:

the tubular member has an end attached to the concave portions having cooperating connecting means for mounting the cylindrical member on the side plates.

21. The muzzleloader firearm of claim 19 wherein:

the side plates have grooves for accommodating the hammer strut means between the hammer and the slide block.

22. The muzzleloader firearm of claim 18 wherein:

the first means include a pair of side plates laterally spaced from each other connecting the barrel to the stock, said tubular member, spring, slide block, and hammer strut means being located in the space between the side plates.

23. The muzzleloader firearm of claim 18 wherein:

the hammer strut means comprise a pair of rigid struts, first pivot means connecting the struts to the slide block.

24. The muzzleloader firearm of claim 23 wherein:

the first means include laterally spaced side plates having inside surfaces, said inside surfaces having grooves for accommodating the struts and said first and second pivot means.

25. The muzzleloader firearm of claim 18 wherein:

the first means includes side plates, and means mounted on the side plates movable to a first position to prevent the hammer from striking the cap and movable to a second position to allow the hammer to strike the cap.

* * * * *